US007187775B2

(12) United States Patent
Fujita

(10) Patent No.: US 7,187,775 B2
(45) Date of Patent: Mar. 6, 2007

(54) AUDIO SIGNAL RECORDING APPARATUS

(75) Inventor: Atsushi Fujita, Hiki-gun (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 140 days.

(21) Appl. No.: 10/801,840

(22) Filed: Mar. 17, 2004

(65) Prior Publication Data

US 2004/0264703 A1 Dec. 30, 2004

(30) Foreign Application Priority Data

Jun. 30, 2003 (JP) ..... 2003-188490

(51) Int. Cl.
*H04R 3/00* (2006.01)
*H04H 5/00* (2006.01)

(52) U.S. Cl. ..... 381/111; 381/11; 381/12; 381/7

(58) Field of Classification Search ..... 381/111, 381/1, 7, 56, 11, 12, 123
See application file for complete search history.

(56) References Cited

U.S. PATENT DOCUMENTS 4,219,789 A * 8/1980 Frangos ..... 333/32
4,433,209 A * 2/1984 Kurosawa et al. ..... 381/1
5,642,424 A * 6/1997 Masaki ..... 381/309
5,655,025 A * 8/1997 Kim et al. ..... 381/11
6,069,960 A * 5/2000 Mizukami et al. ..... 381/74
6,594,366 B1 * 7/2003 Adams ..... 381/74
6,711,268 B2 * 3/2004 Colegrave et al. ..... 381/74
6,748,085 B1 * 6/2004 Yang ..... 381/11

FOREIGN PATENT DOCUMENTS

JP 08293159 A * 11/1996
JP 2001-333500 11/2001

* cited by examiner

*Primary Examiner*—Vivian Chin
*Assistant Examiner*—Devona E. Faulk
(74) *Attorney, Agent, or Firm*—Finnegan, Henderson, Farabow, Garrett & Dunner, L.L.P.

(57) ABSTRACT

When a plug of a monaural microphone is connected to an external microphone input section, a right channel terminal is connected to a GND terminal, and a voltage Vdet will be a GND potential. A DC voltage detection section detects this GND potential, and outputs, for example, an H level signal as a detection signal. In response to this detection signal, a system control section controls a DSP so that, for example, an audio signal of the left channel is recorded by use of both right and left recording channels.

7 Claims, 3 Drawing Sheets

AUDIO SIGNAL RECORDING APPARATUS

CROSS-REFERENCE TO RELATED APPLICATIONS

This application is based upon and claims the benefit of priority from prior Japanese Patent Application No. 2003-188490, filed Jun. 30, 2003, the entire contents of which are incorporated herein by reference.

BACKGROUND OF THE INVENTION

1. Field of the Invention

This invention relates to an audio signal input circuit in a sound recording/reproducing apparatus.

2. Description of the Related Art

An ordinary stereo external microphone is connected to a recording apparatus via a plug having three electrodes. The electrodes are respectively defined, from a plug end, as a left channel (L), a right channel (R) and a ground (GND).

An audio signal from the microphone is input to microphone amplifiers of the right and left channels via the plug, and amplified and then sent to a next stage circuit. In a plug-in power system, power for the microphone is supplied from a microphone power supply circuit of the recording apparatus to the right and left channels of the external microphone respectively via a resistance and an audio signal line.

If a plug of a monaural external microphone is connected to a jack for the stereo external microphone, no signal is input to the right channel amplifier. Sound is recorded only in the left channel, and no sound is recorded in the right channel. This therefore results in wasteful use of a recording medium which records the audio signals, and a sound is output only from the left when reproduced.

Jpn. Pat. Appln. KOKAI Publication No. 2001-333500 (page 4, FIG. 5) discloses an apparatus which determines whether an input audio signal is a stereo sound or monaural sound. In this document, a software stored in a ROM judges whether the input audio signal is stereo or monaural.

A conventional sound recording/reproducing apparatus is not capable of judging whether the microphone connected to a microphone input terminal (microphone jack) is a stereo microphone or monaural microphone. In the document mentioned above, computing processing is performed in an MPU to judge whether the input audio signal is stereo or monaural, but a specific method is not described, and it can not be readily implemented.

BRIEF SUMMARY OF THE INVENTION

A sound recording apparatus according to one embodiment of the present invention comprises: a microphone input terminal having right and left signal channel terminals and a ground terminal; a recording section which records, in a recording medium, right and left audio signals input from the microphone input terminal; a microphone power supply section which supplies power to a microphone connected to the microphone input terminal via the right and left signal channel terminals and the ground terminal; a detection section which detects whether or not a voltage of one of the right and left signal channel terminals is substantially the same as a voltage of the ground terminal, and provides a detection result; and a control section which controls a recording operation of the recording section in accordance with the detection result.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
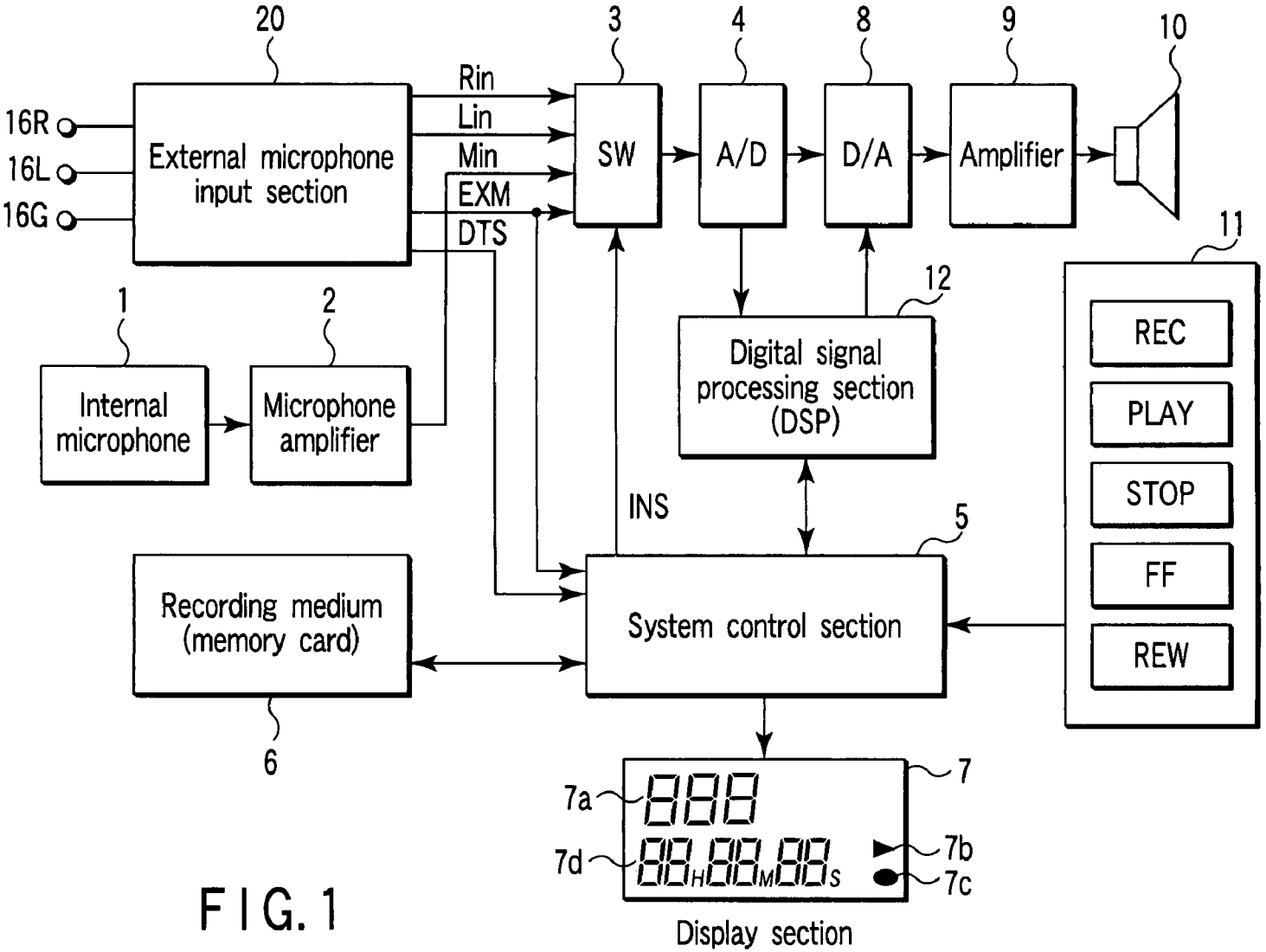
FIG. 1 is a block configuration diagram of a sound recording/reproducing apparatus according to the present invention.

Embodiments of the present invention will hereinafter be described in detail referring to the drawings.

FIG. 1 is a block configuration diagram of a sound recording/reproducing apparatus to which the present invention is applied. An internal microphone 1 converts an input sound into an audio signal, and a microphone amplifier 2 amplifies the audio signal. An external microphone input section 20 inputs and amplifies the audio signal from a stereo or monaural microphone connected to the present apparatus, and provides a right audio signal Rin and a left audio signal Lin. The external microphone input section 20 also detects whether the external microphone is a stereo microphone or monaural microphone, and provides a signal DTS indicating a detection result to a system control section 5. Further, the external microphone input section 20 provides a signal EXM indicating whether or not a microphone plug is plugged into the external microphone input section 20.

A signal switch circuit (SW) 3 selects one of the audio signals Lin and Rin from the external microphone, and an audio signal Min from the internal microphone on the basis of the signal EXM or a signal INS (described later) from the system control section 5, and provides it to an A/D converter 4. When the external microphone is not connected, the signal switch circuit 3 selects the audio signal Min from the microphone amplifier 2. When the microphone plug is plugged into the external microphone input section 20, the external microphone input section 20 outputs, for example, an H (high) level as the signal EXM. In response to the H level of the signal EXM, the signal switch circuit 3 selects the signal from the external microphone input section 20.

The A/D converter 4 converts the analog audio signal selected by the signal switch circuit 3 into a digital signal. Under the control of the system control section 5, a digital signal processing section (DSP) 12 compresses (encodes) the digital signal provided from the A/D converter 4. The system control section 5 may include a recording section (not shown) which records compressed data as a file in a recording medium (semiconductor memory card) 6.

An operation button section 11 is a user interface for inputting user instructions, and includes a record button (REC), a play button (PLAY), a stop button (STOP), a fast-forward button (FF) and a rewind button (REW). The system control section (CPU) 5 controls each circuit block in the present apparatus in accordance with the button depressed by a user.

A display section 7 comprises, for example, an LCD (liquid crystal display), and includes a file number display portion 7*a*, a reproduction mode display portion 7*b*, recording mode display portion 7*c*, and a recording or reproduction elapsed time display portion 7*d*.

In sound reproduction, the system control section 5 reads the audio data recorded as a file in the recording medium 6, and decodes (extends) it by the DSP 12. The decoded audio data is converted into an analog audio signal by a D/A converter 8, amplified by an amplifier 9, and output as a sound by a speaker 10.

Next, a configuration of the external microphone input section 20 according to the present invention will be described.

Figure 2:
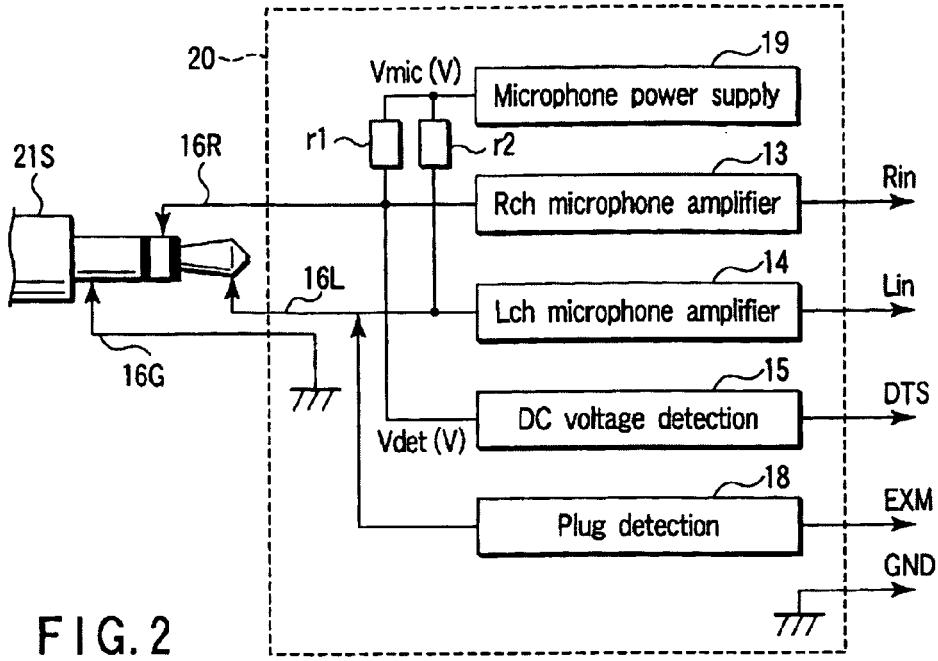
FIG. 2 is a diagram showing a schematic configuration of an external microphone input section 20.

FIG. 2 is a diagram showing a schematic configuration of the external microphone input section 20. In this diagram, an external stereo microphone plug 21S is connected to the external microphone input section 20. The external microphone input section 20 comprises a microphone input terminal having right and left signal channel terminals 16R, 16L and a ground terminal 16G.

A plug-in power system is adopted in the external microphone input section 20. That is, power is supplied to both the right and left channels of the stereo microphone from a microphone power supply 19 via power supply resistances r1 and r2. The audio signals from the microphone are input to microphone amplifiers 13, 14 of both the right and left channels, and amplified and then sent to a next stage. A plug detection system 18 detects whether or not the microphone plug is plugged into the external microphone input section 20, and provides the detection signal EXM.

Figure 3:
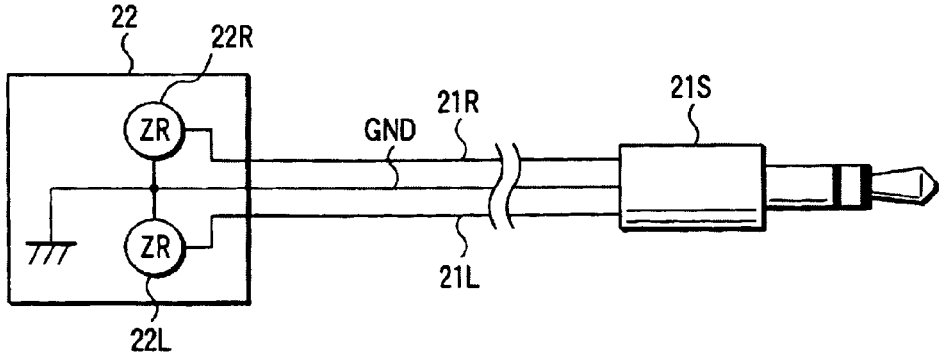
FIG. 3 is a diagram showing a schematic configuration of a stereo microphone.

FIG. 3 is a diagram showing a schematic configuration of a stereo microphone. A stereo microphone 22 is comprised of a right microphone 22R and a left microphone 22L, and each microphone is, for example, an electret capacitor microphone and has an internal resistance ZR. Each microphone is supplied with power via a plug 21S and signal lines 21R, 21L in a cable, and converts an input sound into an audio signal, and then outputs it to the signal lines 21R, 21L.

Next, a DC voltage detection section 15 provided in the external microphone input section 20 will be described.

Figure 4:
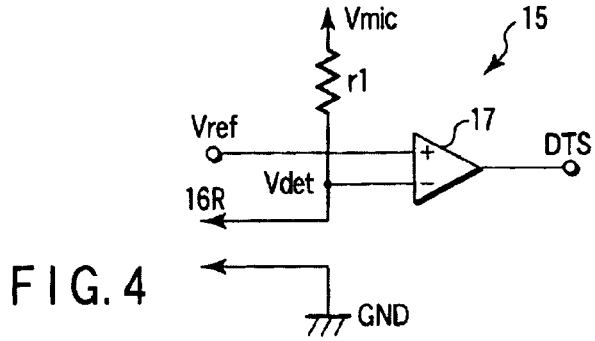
FIG. 4 is a diagram showing a configuration example of a DC voltage detection section 15.

FIG. 4 shows a configuration example of the DC voltage detection section 15. The DC voltage detection section 15 detects that a voltage of a right channel power supply line is substantially a DC voltage of 0 V, thereby determining whether the connected external microphone is stereo or monaural. The right channel signal input terminal 16R is connected to an inverted terminal of a comparator 17, and also connected to one end of the resistance r1. The other end of the resistance r1 is connected to the microphone power supply 19, and supplied with a microphone power supply voltage Vmic. A noninverted terminal of the comparator 17 is supplied with a threshold voltage Vref.

A detection voltage Vdet in the DC voltage detection section 15 will be a voltage in which the microphone power supply voltage Vmic is resistance-divided by the power supply resistance r1 and the internal resistance ZR of the right channel microphone. The Vdet is indicated by the following Equation.

$$Vdet=(ZR/(r1+ZR))*Vmic[V] \quad (1)$$

Figure 5:
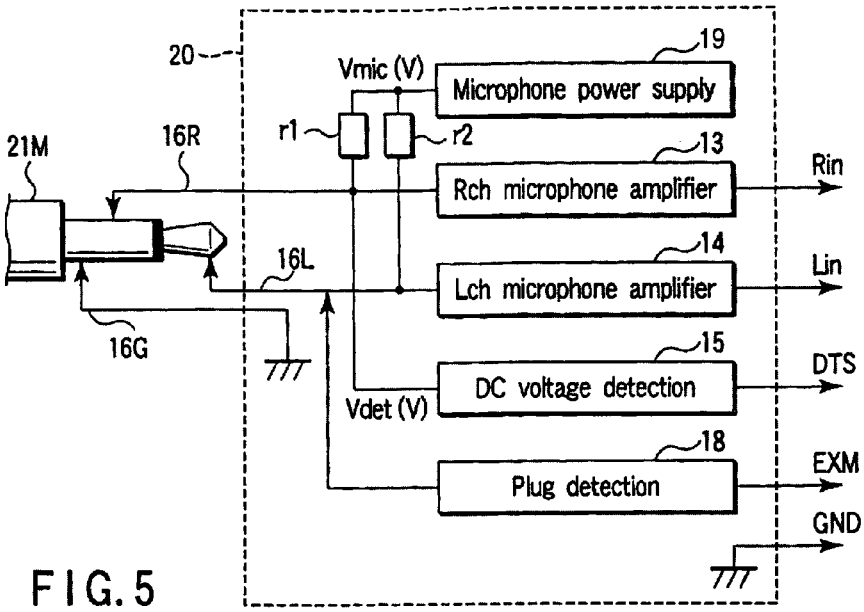
FIG. 5 shows the external microphone input section 20 when a monaural microphone is connected thereto.

FIG. 5 shows the external microphone input section 20 when a monaural microphone is connected thereto. Due to a plug shape of a plug 21M, the right channel power supply resistance r1 is connected to the GND via the plug, so that the Vdet will be a GND potential.

$$Vdet=0[V] \quad (2)$$

The threshold voltage Vref for determination is decided from Equations (1) and (2), and the detection voltage Vdet is compared with the threshold voltage Vref. If the Vdet is smaller than the threshold voltage Vref, an H level signal is output as the detected signal DTS from the comparator 17, or if the Vdet is above the threshold voltage Vref, an L (low) level signal is output as the detected signal DTS. The system control section 5 determines that a monaural microphone is connected when the detected signal DTS is on the H level, and that a stereo microphone is connected when the detected signal DTS is on the L level.

When the monaural microphone is connected to the external microphone input section 20, the system control section 5 controls the DSP 12 so that, for example, the audio signal of the left channel is recorded by use of both right and left recording channels. This makes it possible to output a sound to both the right and left channels in reproduction. When the monaural microphone is connected to the external microphone input section 20, the system control section 5 may also control the DSP 12 so that only the audio signal of the left channel is recorded in the recording medium 6 by use of the left recording channel. This makes it possible to prolong recording time of the audio signal that can be recorded in the recording medium 6, as compared with conventional cases in which a right channel signal with no sound is simultaneously recorded.

Figure 6:
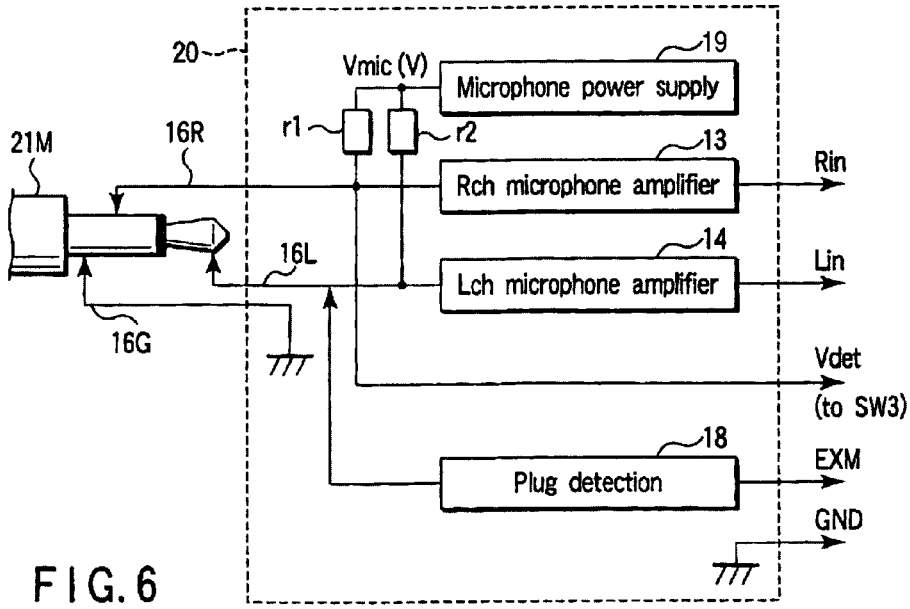
FIG. 6 is a diagram showing a configuration in a second embodiment of the external microphone input section.

FIG. 6 is a diagram showing a configuration in a second embodiment of the external microphone input section 20.

In the present embodiment, the voltage Vdet of the right signal terminal 16R is measured by the A/D converter 4, and the system control section 5 judges whether the external microphone is stereo or monaural. Generally, a DC voltage can not be input to the microphone amplifiers 13, 14 because a capacitor is inserted in series into an signal input line (not shown). Therefore, the voltage Vdet of the right signal terminal is input to the A/D converter 4 without passing through the capacitor in the present embodiment.

The voltage Vdet of the right signal terminal is first supplied to the signal switch circuit (SW) 3 (not shown). For example, when the power from the microphone power supply 19 is turned on, or every time the microphone plug is plugged into the external microphone input section 20, the system control section 5 switches the signal switch circuit (SW) 3 to a Vdet side by the signal INS, so as to read the voltage Vdet via the A/D converter 4 and compare it with a predetermined threshold value to detect whether Vdet is equal to a DC voltage of 0 V, thereby determining whether the connected microphone plug is monaural. If a value of the voltage Vdet is smaller than the predetermined threshold value, the system control section 5 judges that a monaural plug is connected to the external microphone input section 20, and changes a recording operation of the digital signal processing section 12 for monaural use as described above. The terms "left" and "right" used herein to describe the left and right channels and corresponding features in the illustrated embodiments, are only relative terms and can be interchanged within the scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A sound recording apparatus comprising:

a microphone input terminal having right and left signal channel terminals and a ground terminal, wherein one of the right and left signal channel terminals is connected to the ground terminal when a monaural microphone is connected to the microphone input terminal;

a recording section which records, in a recording medium, right and left audio signals input from the microphone input terminal;

a microphone power supply section which supplies power to a microphone connected to the microphone input terminal via the right and left signal channel terminals and the ground terminal;

a detection section which detects whether or not a voltage of the one of the right and left signal channel terminals is substantially equal to a ground voltage, and provides a detection result, wherein the detected voltage of one of the right and left signal channel terminals is a voltage of the power supplied to the microphone resistance-divided by a power supply resistance and an internal resistance of the corresponding one of a right and left channel of the microphone when a stereo microphone is connected to the microphone input terminal; and a control section which controls a recording operation of the recording section in accordance with the detection result.

2. The sound recording apparatus according to claim 1, wherein the detection section comprises a comparator which compares the detected voltage of the right signal channel terminal with a predetermined threshold value, and an output voltage of the comparator is provided as the detection result.

3. The sound recording apparatus according to claim 1, wherein when the detection result indicates that the detected voltage of the right signal channel terminal is substantially equal to that of the ground terminal, the control section controls the recording section so that only the left audio signal input from the left signal channel terminal is recorded.

4. The sound recording apparatus according to claim 1, wherein the recording section has right and left sound recording channels, and when the detection result indicates that the detected voltage of the right signal channel terminal is substantially equal to that of the ground terminal, the control section controls the recording section so that the left audio signal input from the left signal channel terminal is recorded into the left sound recording channel and into the right sound recording channel.

5. A sound recording apparatus comprising:

a microphone input terminal having right and left signal channel terminals and a ground terminal, wherein one of the right and left signal channel terminals is connected to the ground terminal when a monaural microphone is connected to the microphone input terminal;

microphone amplifiers which amplify right and left audio signals input from the microphone input terminal;

an A/D converter which converts right and left analog signals into digital signals amplified by the microphone amplifiers;

a recording section which records the digital signals in a recording medium;

a microphone power supply section which supplies power to a microphone connected to the microphone input terminal via the right and left signal channel terminals and the ground terminal;

a detection section which uses the A/D converter to convert a voltage of one of the right and left signal channel terminals into voltage data, compares the voltage data with the predetermined threshold value, thus detects whether or not the voltage of one of the terminals is substantially equal to a ground voltage, and provides a detection result; and a control section which controls a recording operation of the recording section in accordance with the detection result, wherein the detected voltage of one of the right and left signal channel terminals is a voltage of the power supplied to the microphone resistance-divided by a power supply resistance and an internal resistance of the corresponding one of a right and left channel of the microphone when a stereo microphone is connected to the microphone input terminal.

6. The sound recording apparatus according to claim 1, wherein the detection section detects whether or not the detected voltage of one of the terminals is equal to the ground voltage every time a microphone plug is plugged into the microphone input terminal.

7. The sound recording apparatus according to claim 5, wherein the detection section detects whether or not the detected voltage of one of the terminals is equal to the ground voltage when power from the microphone power supply section is turned on.

* * * * *

UNITED STATES PATENT AND TRADEMARK OFFICE

CERTIFICATE OF CORRECTION

PATENT NO. : 7,187,775 B2
APPLICATION NO. : 10/801840
DATED : March 6, 2007
INVENTOR(S) : Fujita It is certified that error appears in the above-identified patent and that said Letters Patent is hereby corrected as shown below:

Claim 5, column 6, line 27, change "detection result;" to --detection result, wherein the detected voltage of one of the right and left signal channel terminals is a voltage of the power supplied to the microphone resistance-divided by a power supply resistance and an internal resistance of the corresponding one of a right and left channel of the microphone, when a stereo microphone is connected to the microphone input terminal; and--.

Claim 5, column 6, line 30, change "result," to --result.--, then delete the remainder of the paragraph.

Signed and Sealed this

First Day of May, 2007

JON W. DUDAS
*Director of the United States Patent and Trademark Office*